US006331326B1

(12) United States Patent
Tsunoda et al.

(10) Patent No.: US 6,331,326 B1
(45) Date of Patent: Dec. 18, 2001

(54) METHOD FOR FORMING COATING FILM AND COATING COMPOSITION

(75) Inventors: Takeshi Tsunoda, Tokyo; Shinji Mitsumune, Fujisawa, both of (JP)

(73) Assignee: BASF NOF Coatings Co., Ltd., Yokohama (JP)

( * ) Notice: Subject to any disclaimer, the term of this patent is extended or adjusted under 35 U.S.C. 154(b) by 0 days.

(21) Appl. No.: 09/445,526

(22) PCT Filed: Apr. 14, 1999

(86) PCT No.: PCT/JP99/01993

§ 371 Date: Dec. 7, 1999

§ 102(e) Date: Dec. 7, 1999

(87) PCT Pub. No.: WO99/54415

PCT Pub. Date: Oct. 28, 1999

(30) Foreign Application Priority Data

Apr. 15, 1998 (JP) ..... 10-104997
Jan. 29, 1999 (JP) ..... 11-22409
Jan. 29, 1999 (JP) ..... 11-022410

(51) Int. Cl.[7] ..... B05D 1/02; B05D 1/36; B05D 5/06

(52) U.S. Cl. ..... 427/202; 427/470; 427/486; 427/203; 427/205; 427/404; 427/421; 106/403; 106/404

(58) Field of Search ..... 427/470, 486, 427/202, 203, 205, 404, 409, 407.1, 421, 427, 419.1, 419.3; 106/403–404

(56) References Cited

U.S. PATENT DOCUMENTS 4,318,747 * 3/1982 Ishijima et al. .
4,680,204 * 7/1987 Doo et al. .
5,244,696 * 9/1993 Hazan et al. .

* cited by examiner

*Primary Examiner*—Fred J. Parker
(74) *Attorney, Agent, or Firm*—Flynn, Thiel, Boutell & Tanis, P.C.

(57) ABSTRACT

A coating film which has no problems in its film properties and is superior in hiding power for hiding sand scratches on the substrate and exhibiting a continuous plated metal-like appearance is formed in a stable manner, by coating the substrate with a primer (A) and/or a first metallic paint (B) containing non-leafing type aluminum flakes (a) having thicknesses in the range from 0.1 to 1 $\mu$m and an average particle size of 1–60 $\mu$m and, then, coating with a second metallic paint (C) containing small, thin metal flakes (b) having thicknesses not greater than 0.08 $\mu$m and an average particle size of 5–40 $\mu$m.

15 Claims, No Drawings

METHOD FOR FORMING COATING FILM AND COATING COMPOSITION

FIELD OF THE TECHNIQUE

The present invention relates to a method for forming a coating film exhibiting an appearance of plated metal and to a coating composition adapted for forming a coating film exhibiting a plated metal-resembling appearance.

BACKGROUND OF THE TECHNIQUE

There has been used a coating composition comprising an aluminum flake pigment having flake thicknesses in the range of 0.1–1 μm and an average particle size of 5–60 μm, which has been treated by grinding in a ball mill together with a fatty acid, for providing the coating film with a brilliant appearance.

The aluminum flakes to be blended in the metallic paints as a brightening pigment are classified according to their properties into a leafing type and a non-leafing type. The leafing type aluminum flake pigment is available usually in a state in which the flakes are treated by grinding them together with stearic acid. Due to a reduced interfacial tension, this pigment is liable to float up onto an upper layer of the metallic coating film when being coated and to form a structured coating layer in which the flakes align over one another in parallel to the substrate, resulting in an appearance of successive aluminum layers. However, the aluminum flake pigment which has floated up on the top face of the upper layer is not fixed in the coating film after the coating film cures, so that the flakes may easily be peeled off by touch. On the other hand, when a clear coating is applied onto an uncured coating film in a wet-on-wet technique, the orientation of the aluminum flakes is disturbed and the appearance deteriorates. When a clear coating is applied onto the metallic coating film after the film has been heat-cured, a reliable adhesion of the coated film and the clear coating layer will not be guaranteed.

For these reasons, the practice has been to use principally the latter, i.e. non-leafing type aluminum flakes in industrial paints.

In conventional metallic paints containing only non-leafing type aluminum flakes, these flakes are usually contained therein after having been ground together with oleic acid, whereby a problem is brought about in that the aluminum flakes added as a brightening pigment have a larger thickness and may be dispersed within the metallic coating layer upon its application on a substrate, so that each aluminum flake is visually recognizable as a discreet particle and a plated metal-like appearance of the coating is not attained, though the adhesion of the metallic coating to the layer of the clear coating is better.

As a coating composition in which the problem of appearance of a metallic coating is improved, there has been proposed in Japanese Patent Kokai Sho-53–9836 A a coating composition characterized in that it comprises a volatile carrier, fine metal particles and a binding material, wherein the fine metal particles consist of metal platelets having thicknesses not greater than 1,000 Å shaped generally irregularly and present in such an amount that the weight ratio of the binding material to the metal platelets is in the range from 0.05/1 to 10/1. This metallic coating composition is, however, inferior in hiding power for hiding sand scratches on the substrate and does not permit the formation of a coating film exhibiting a superior continuous plated metal-like appearance in a stable manner.

An object of the present invention is to provide a method for forming a coating film, in which a coating film having no problems in its properties and which is superior not only in its hiding power for hiding sand scratches on the substrate but also in a continuous plated metal-like appearance can be built up in a stable manner.

Another object of the present invention is to provide a coating composition which can be applied by the method for forming a coating film as above and form a coating film having satisfactory film properties and which is superior not only in its hiding power for hiding sand scratches on the substrate but also in that a continuous plated metal-like appearance can be built up in a stable manner.

DISCLOSURE OF THE INVENTION

The present invention consists of the following methods for forming a coating film and a coating composition:

(1) A method for forming a coating film on a substrate comprising applying onto the substrate a primer (A) and/or a first metallic paint (B) containing non-leafing type aluminum flakes (a) having thicknesses in the range from 0.1 to 1 μm and an average particle size in the range from 1 to 60 μm and, then, applying thereonto a second metallic paint (C) containing small thin metal flakes (b) having thicknesses not greater than 0.08 μm and an average particle size in the range from 5 to 40 μm.

(2) The method as defined in the above (1), wherein the primer (A) and/or the first metallic paint (B) and the second metallic paint (C) are applied sequentially on the substrate by a wet-on-wet technique.

(3) The method as defined in the above (1), wherein a heating step is incorporated after the application of the primer (A) and/or the first metallic paint (B), whereupon the second metallic paint (C) is applied thereonto.

(4) A method for forming a coating film on a substrate comprising applying onto the substrate a primer (A) and/or a first metallic paint (B) containing non-leafing type aluminum flakes (a) having thicknesses in the range from 0.1 to 1 μm and an average particle size in the range from 1 to 60 μm and, then, applying thereonto a second metallic paint (C) containing small thin metal flakes (b) having thicknesses not greater than 0.08 μm and an average particle size in the range from 5 to 40 μm and a clear coating (D) successively.

(5) The method as defined in the above (4), wherein the primer (A) and/or the first metallic paint (B), the second metallic paint (C) and the clear coating (D) are applied sequentially on the substrate by a wet-on-wet technique.

(6) The method as defined in the above (4), wherein a heating step is incorporated after the application of the primer (A) and/or the first metallic paint (B), whereupon the second metallic paint (C) and the clear coating (D) are applied sequentially thereonto.

(7) The method as defined in the above (4), wherein a heating step is incorporated after the primer (A) and/or the first metallic paint (B) and, then, the second metallic paint (C) have sequentially been applied, whereupon the clear coating (D) is applied thereonto.

(8) The method as defined in the above (4), wherein a heating step is incorporated after the application of the primer (A) and/or the first metallic paint (B), followed by application of the second metallic paint (C) thereonto with subsequent heating of the coating, whereupon the clear coating (D) is applied thereonto.

(9) The method for forming a coating film on a substrate by spray-coating a coating composition containing a solvent, the small thin metal flakes (b) and a film-forming resin component on the substrate using an air spray gun as defined in any one of the above (1) to (8), wherein the small thin metal flakes (b) have thicknesses not greater than 0.08 μm and an average particle size in the range from 5 to 40 μm and the film-forming resin component comprises a cellulosic resin or a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a nozzle diameter not greater than 3 mm, with the spray air pressure at the air cap being in the range from 45 to 245 kPa.

(10) The method for forming a coating film on a substrate by spray-coating a coating composition comprising a solvent, the small thin metal flakes (b) and a film-forming resin component on the substrate using a low-pressure air spray gun as defined in any one of the above (1) to (8), wherein the small thin metal flakes (b) have thicknesses not greater than 0.08 μm, and an average particle size in the range from 5 to 40 μm and wherein the film-forming resin component comprises a cellulosic resin or a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the low-pressure air spray gun has a nozzle diameter not greater than 3 mm, with the spraying air discharge rate being in the range from 400 to 600 liters/min.

(11) A method for forming a coating film on a substrate by spray-coating a coating composition containing a solvent, small thin metal flakes (b) and a film-forming resin component on the substrate using an air spray gun, wherein the small thin metal flakes (b) have thicknesses not greater than 0.08 μm and an average particle size in the range from 5 to 40 μm and the film-forming resin component comprises a cellulosic resin or a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a nozzle diameter not greater than 3 mm, with the air spray pressure at the air cap being in the range from 45 to 245 kPa.

(12) A method for forming a coating film on a substrate by spray-coating a coating composition containing a solvent, small thin metal flakes (b) and a film-forming resin component on the substrate using a low-pressure air spray gun, wherein the small thin metal flakes (b) have thicknesses not greater than 0.08 μm and an average particle size in the range from 5 to 40 μm and the film-forming resin component is constituted of a cellulosic resin or of a cellulosic resin and other resin(s) than cellulosic one, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the low-pressure air spray gun has a nozzle diameter not greater than 3 mm, with the spraying air discharge rate being in the range from 400 to 600 liter/min.

(13) A metallic coating composition to be used in the method defined in any one of the above (1) to (10) as the first metallic paint (B), which comprises a solvent, a brightening pigment and a film-forming resin component, the coating composition comprising non-leafing type aluminum flakes (a) or non-leafing type aluminum flakes (a) and small thin metal flakes (b) as the brightening pigment, with the weight ratio of the non-leafing type aluminum flakes (a) to the small thin metal flakes (b) being in the range from 1/0 to 1/20 and the weight ratio of the brightening pigment to the film-forming resin component being in the range from 1/0.3 to 1/40.

(14) A metallic coating composition to be used in the method defined in any one of the above (1) to (10) as the second metallic paint (C), which comprises a solvent, a brightening pigment and a film-forming resin component, the coating composition comprising small thin metal flakes (b) or small thin metal flakes (b) plus non-leafing type aluminum flakes (a) as the brightening pigment, with the weight ratio of the small thin metal flakes (b) to the non-leafing type aluminum flakes (a) being in the range from 1/0 to 1/20 and the weight ratio of the brightening pigment to the film-forming resin component being in the range from 1/0.3 to 1/40.

(15) A coating composition comprising a solvent, a brightening pigment and a film-forming resin component, the coating composition containing, as the brightening pigment, small thin metal flakes (b) having thicknesses not greater than 0.08 μm and an average particle size in the range from 5 to 40 μm and non-leafing type aluminum flakes (a) having thicknesses in the range from 0.1 to 1 μm and an average particle size in the range from 1 to 60 μm, with the weight ratio of the brightening pigment to the film-forming resin component being in the range from 1/0.3 to 1/40 and the weight ratio of the small thin metal flakes (b) to the non-leafing type aluminum flakes (a) being in the range from 1/0.05 to 1/20.

As the substrate on which the coating film is formed according to the present invention, there may be enumerated, for example, metals, such as iron, aluminum, copper and alloys of them; inorganic materials, such as glass and concrete; plastic materials comprising FRPs and formed articles of resins, such as polyethylene, polypropylene, ethylene/vinyl acetate copolymer, polyamides, polyacrylates, polyesters, polyvinyl chloride, polyvinylidene chloride, polycarbonates, polyurethane and acrylonitrile/butadiene/styrene copolymer; wood and paper.

The substrate may be coated either directly, or after having been coated with an adequate undercoat or precoat, with coating compositions comprising a primer (A), a first metallic paint (B), a second metallic paint (C) and a clear coating (D).

As the primer (A) to be incorporated according to the present invention, there may be employed those which have heretofore been used as the primer for coatings, without any restriction. Also, for the film-forming resin to be used in the primer (A), there is no special limitation and those which have hitherto been employed for paints may be used without any restriction. Representative film-forming resins include acrylic resins, polyolefin resins, chlorinated polyolefin resins, polyester resins, alkyd resins and cellulosic resins, which may be used either alone or in a combination of two or more for a non-cross-linking lacquer type paint or which may be used for a curable one-liquid or two-liquid type cross-linking paint in combination with a cross-linking agent, such as an isocyanate compound or a melamine resin.

The primer (A) to be used according to the present invention may favorably be blended with a flat pigment, in order to increase the hiding power for hiding sand scratches on the substrate and to build up a coating film having a continuous plated metal-like appearance in a stable manner.

As the flat pigment, a non-leafing type aluminum flake pigment is suitable, which may favorably have flake thicknesses in the range from 0.1 to 1 μm, in particular, in the range from 0.1 to 0.5 μm, and an average particle size not greater than 20 μm. Specific examples of other flat pigments include talc, flaky mica, laminar iron oxide, glass flakes, titanium-coated graphite and titanium metal flakes.

The flat pigment may favorably be incorporated in the primer (A) in an amount of 0.1–40 parts by weight, preferably 5–25 parts by weight, per 100 parts by weight of the film-forming resin in the primer (A). If the blended amount of the pigment exceeds 40 parts by weight, a cohesive failure of the primer occurs upon the coating film adhesion test. In the primer (A) to be used according to the present invention, color pigment, extender and other additives may be incorporated as required.

The coating composition of the primer (A) is used while dispersed or dissolved in water or in an organic solvent. As the organic solvent, those based on an aromatic hydrocarbon, ester, ketone, alcohol and ether may be employed.

The first metallic paint (B) used according to the present invention consists of a coating composition which comprises a film-forming resin and a solvent and contains, as a brightening pigment, a non-leafing type aluminum flake pigment made of aluminum flakes which have been ground together with a fatty acid, such as oleic acid or the like, in a ball mill and which have thicknesses in the range from 0.1 to 1 μm, especially from 0.1 to 0.5 μm, and an average particle size not greater than 60 μm, especially not greater than 20 μm. When using an aluminum flake pigment having thicknesses greater than 1 μm or having an average particle size greater than 60 μm, the wet film of the first metallic paint (B) may have a rough surface, resulting in a debasement of a continuous plated metal-like appearance.

For the film-forming resin to be incorporated in the first metallic paint (B), there is no limitation and those which have hitherto been used in paints can be employed without restriction. Representative film-forming resins include acrylic resins, polyolefin resins, chlorinated polyolefin resins, polyester resins, alkyd resins and cellulosic resins, which may be used either alone or in a combination of two or more of them to formulate a non-crosslinking lacquer or to formulate a single liquid type or two-liquid type crosslinking paint under combination with a crosslinking agent, such as an isocyanate compound or a melamine resin.

As the brightening pigment for the first metallic paint (B), there may be incorporated non-leafing type aluminum flakes (a) solely or non-leafing type aluminum flakes (a) together with small thin metal flakes (b). The small thin metal flakes (b) may have flake thicknesses not greater than 0.08 μm, preferably within a range from 0.02 to 0.06 μm, and an average particle size in the range from 5 to 40 μm, preferably in the range from 5 to 20 μm. As the small thin metal flakes (b), there may be enumerated those which are produced by, for example, vapor deposition (including vacuum) and electroless and sputtering processes. As the products found in the market, there may be enumerated, for example, METALURE (trademark, a product of Avery Dennison having flake thicknesses in the range from 0.01 to 0.08 μm and an average particle size in the range from 6 to 16 μm) and METASHEEN (trademark, a product of Wolstenholme International Ltd., having flake thicknesses in the range from 0.01 to 0.08 μm and an average particle size in the range from 8 to 20 μm). The material of the small thin metal flakes is not specifically limited and may be exemplified by Al, Mg, Cu, Au and Ag.

The weight ratio of the non-leafing type aluminum flakes (a) relative to the small thin metal flakes (b) may be in the range from 1/0 to 1/20, preferably from 1/0 to 1/10. If the proportion of the non-leafing type aluminum flakes (a) is less than 1/20, the hiding power thereof for hiding the sand scratches on the substrate becomes inferior and the stable formation of a coating film exhibiting a continuous plated metal-like appearance is impossible. This may be due to that the thicknesses of the small thin metal flakes (b) being not greater than 0.08 μm, so that they deform and orient along the sand scratch lines on the substrate.

The amount of the brightening pigment in the first metallic paint (B) as the weight ratio of the brightening pigment to the film-forming resin may be in the range from 1/0.3 to 1/40, preferably from 1/1 to 1/20. When the proportion of the brightening pigment exceeds 1/0.3, a cohesive failure may occur upon the coating film adhesion test. When the proportion of the brightening pigment is lower than 1/40, the hiding power thereof for hiding the sand scratches on the substrate becomes inferior.

In the first metallic paint (B) to be used according to the present invention, other pigment(s) and additives may be incorporated as required. As other pigments, those which have been used hitherto in paints may be employed, for example, those of organic pigments, such as azo lake pigments, phthalocyanine pigments, indigo pigments, perinone pigments, perylene pigments, quinophthalone pigments, dioxazine pigments and quinacridone pigments. As those based on inorganic compounds, there may be enumerated, for example, chrome yellow, yellow iron oxide, red iron oxide, carbon black and titanium dioxide. As other additives, there may be enumerated, for example, UV absorbers, such as benzotriazole and oxanilide; antioxidants, such as those based on benzophenol; leveling agents, such as those based on silicone; viscosity controllers, such as waxes and organic bentonites; and curing catalysts.

The first metallic paint (B) used according to the present invention is applied onto the substrate under dispersion or dissolution in water or in an organic solvent. As the organic solvent, there may be used those based on aromatic hydrocarbons, esters, ketones, alcohols and ethers.

In the first metallic paint (B) to be used according to the present invention, there may be incorporated non-leafing type aluminum flakes (a) which resist deformation along the sand scratch lines on the substrate, wherein the hiding power of the paint can be increased by adjusting the amount of addition of the aluminum flakes (a) within an adequate range.

The second metallic paint (C) is constituted by comprising the small thin metal flakes (b) as the brightening pigment and a film-forming resin. Since the small thin metal flakes (b) have thicknesses as small as not greater than 0.08 μm, the distinction between individual flakes is scarcely discriminable by a glance, so that a coating film exhibiting a continuous plated metal-like appearance can be obtained therewith.

For the film-forming resin in the second metallic paint (C) to be used according to the present invention, those which have hitherto been used in paints can be employed without any restriction. There may be used, for example, acrylic resins, polyolefin resins, chlorinated polyolefin resins, polyester resins, alkyd resins and cellulosic resins, either alone or in a combination of two or more, by formulating into a non-cross linking lacquer or into a single liquid or two liquid cross-linking paint under combination with a cross-linking agent, such as an isocyanate or a melamine resin.

The weight proportion between the small thin metal flakes (b) and the film-forming resin may be in the range from 1/0.3 to 1/40, preferably from 1/1 to 1/20. When the proportion of the film-forming resin relative to the small thin metal flakes (b) is lower than 1/0.3, a cohesive failure may occur upon the coating film adhesion test. On the other hand, when the proportion exceeds 1/40, the tendency of the small thin metal flakes (b) to cause orientation becomes insufficient, so that the plated metal-like appearance is debased.

For the brightening pigment in the second metallic paint (C), the small thin metal flakes (b) may be used together with the non-leafing type aluminum flakes (a) in a proportion within an adequate range. The weight proportion between the small thin metal flakes (b) and the non-leafing type aluminum flakes (a) may be in the range from 1/0 to 1/20, preferably in the range from 1/0.05 to 1/20, more preferably in the range from 1/0.05 to 1/10, most preferably in the range from 1/0.1 to 1/2. When the proportion of the small thin metal flakes (b) is less than 1/20, the distinction between the piled individual non-leafing type aluminum flakes (a) becomes visible so that forming a coating film exhibiting a continuous plated metal-like appearance cannot be attained.

The amount of the brightening pigment in the second metallic paint (C) in the case of using the small thin metal flakes (b) together with the non-leafing type aluminum flakes (a) in terms of weight proportion of the brightening pigment relative to the film-forming resin may be in the range from 1/0.3 to 1/40, preferably from 1/1 to 1/20. If the proportion of the brightening pigment exceeds 1/0.3, a cohesive failure may occur upon the coating film adhesion test. On the other hand, if the proportion of the brightening pigment is lower than 1/40, the tendency of the brightening pigment to cause orientation decreases and the plated metal-like appearance is debased.

In the second metallic paint (C), other pigment(s) and additives may be incorporated as required. As other pigments, those which have usually been used hitherto in paints may be employed, for example, organic pigments, such as azo lake pigments, phthalocyanine pigments, indigo pigments, perinone pigments, perylene pigments, quinophthalone pigments, dioxazine pigments and quinacridone pigments. As those based on inorganic compounds, there may be enumerated, for example, chrome yellow, yellow iron oxide, red iron oxide, carbon black and titanium dioxide. As other additives, there may be enumerated, for example, UV absorbers, such as benzotriazole and oxanilide; antioxidants, such as those based on benzophenol; leveling agents, such as those based on silicone; viscosity controllers, such as waxes and organic bentonites; and curing catalysts.

The second metallic paint (C) is applied onto the substrate after being dispersed or dissolved in water or in an organic solvent. As the organic solvent, there may be used those based on aromatic hydrocarbons, esters, ketones, alcohols and ethers.

In the second metallic paint (C), there may be incorporated the small thin metal flakes (b), wherein a coating film exhibiting a continuous plated metal-like appearance can be formed by adjusting the amount of addition of the metal flakes (b) within an adequate range.

In the case of incorporating the small thin metal flakes (b) in the first metallic paint (B) and in the case of incorporating the non-leafing type aluminum flakes (a) in the second metallic paint (C), the proportion of the non-leafing type aluminum flakes (a) relative to the entire amount of the brightening pigment is chosen to be greater for the first metallic paint (B) than for the second metallic paint (C) and the proportion of the small thin metal flakes (b) relative to the entire brightening pigment is chosen to be greater for the second metallic paint (C) than for the first metallic paint (B).

In practicing the method for forming the coating film according to the present invention, the primer (A) and/or the first metallic paint (B) for increasing the hiding power for hiding the sand scratches on the substrate is first applied onto the substrate and, then, the second metallic paint (C) capable of forming a coating film exhibiting a continuous plated metal-like appearance is applied thereonto. Here, it is permitted to coat the substrate first with either one of the primer (A) and the first metallic paint (B), or first with the primer (A) and, then, with the first metallic paint (B) thereon.

In these cases, it is permissible that the primer (A) and/or the first metallic paint (B) and, then, the second metallic paint (C) are applied in a wet-on-wet technique successively or the primer (A) and/or the first metallic paint (B) is first applied with subsequent heating and, then, the second metallic paint (C) is applied thereonto with subsequent heating. In the method for forming a coating film according to the present invention, it is permitted to first apply the primer (A) onto the substrate. It is preferable to apply a clear coating (D) onto the coating film formed by the application of the metallic paint compositions.

The clear coating (D) to be applied according to the present invention is not specifically restricted and those film-forming resins which have hitherto been used for thermosetting paint compositions may be used without limitation. As representative thermosetting film-forming components, basal resins as the coating film-forming resin and cross-linking agents as the curing agent are included. For the basal resins, there is no special limitation and those which have hitherto been used as the film-forming resin in thermosetting coating composition can be employed without restriction. Specific examples thereof include acrylic resins, polyester resins, alkyd resins, fluororesins, silicones and epoxy resins. They may be used either alone or in a combination of two or more. As the functional groups included in the basal resins and participating in the cross-linking reaction, there may be exemplified hydroxyl groups, carboxyl groups, acid anhydride groups, epoxy groups and silane groups.

Also, the cross-linking agent is not specifically limited and those which have hitherto been used for the cross-linking agent in conventional thermosetting paint compositions can be employed without restriction. Specific examples of the cross-linking agent include melamine resins, isocyanate compounds and epoxy compounds. They may be employed either alone or in a combination of two or more.

In the clear coating (D) to be used according to the present invention, other components may be contained if necessary. For such other components, those additives which have hitherto been used in paints can be employed without restriction. Specific examples thereof include antifoaming agents based on acrylic resins and silicones, light stabilizers based on hindered amine (HALS), matting agents, antioxidants and curing catalysts.

The coating composition for the clear coating (D) may be brought into practical use after being dispersed or dissolved in water or in an organic solvent. As the organic solvent, there may be employed those based on aromatic hydrocarbons, esters ketones, alcohols and ethers.

In the case of forming three coating films, i.e. for the primer (A) and/or the first metallic paint (B), for the second metallic paint (C) and for the clear coating (D), in the method according to the present invention, these plurality of coating films may be formed by applying the coating compositions corresponding to them successively over one another.

Here, it is permissible to practice the coating procedures either in such a manner that the substrate is first coated with the primer (A) and/or the first metallic paint (B), whereupon the second metallic paint (C) and the clear coating (D) are applied in a wet-on-wet technique successively thereonto; that the substrate is first coated with the primer (A) and/or the first metallic paint (B) with subsequent heating, whereupon the second metallic paint (C) and the clear coating (D) are applied thereonto; that the substrate is first coated with the primer (A) and/or the first metallic paint (B) and with the second metallic paint (C) successively with subsequent heating, whereupon the clear coating (D) is applied thereonto; or that the substrate is first coated with the primer (A) and/or the first metallic paint (B) with subsequent heating, whereupon the second metallic paint (C) is applied thereonto with subsequent heating, followed by coating thereon with the clear coating (D).

For the practical application of the coating compositions according to the present invention, conventionally known coating practices, such as a technique in which a spray coating apparatus is used, an air-spraying technique and electrostatic coating, may be employed. A favorable practice for applying a coating composition containing the small thin metal flakes (b) by an air-spraying technique is described below.

A preferred coating composition employed in this technique is constituted of at least a solvent, small thin metal flakes (b) and a coating film-forming resin composed of a cellulosic resin (c) or of a cellulosic resin (c) with another resin (d). The small thin metal flakes (b) have thicknesses not greater than 0.08 $\mu$m, preferably in the range from 0.02 to 0.06 $\mu$m, and an average particle size in the range from 5 to 40 $\mu$m, preferably from 5 to 20 $\mu$m. The resin (d) may be different from the cellulosic resin (c). The weight proportion of the small thin metal flakes (b) to the coating film-forming resin is in the range from 1/0.3 to 1/40, preferably from 1/1 to 1/20, wherein the cellulosic resin (c) is contained in the coating film-forming resin in a content in the range from 5 to 100% by weight, preferably from 10 to 100% by weight, and wherein the coating composition has a solid matter content upon the application thereof in the range from 0.1 to 10% by weight, preferably from 0.5 to 8% by weight.

As the cellulosic resin (c), there may be employed those conventionally used for paints, such as cellulose nitrate, cellulose acetate butyrate, cellulose acetate propionate and cellulose acetate. Among them, cellulose acetate butyrate is especially preferred. The cellulosic resin (c) may favorably be incorporated in the coating film-forming resin component in an amount of 5–100% by weight, in particular, in an amount of 10% by weight or more, in the case of applying a clear coating (D) onto the uncured coating film in a wet-on-wet technique. If the amount of the cellulosic resin (c) in the coating film-forming resin component is lower than 5% by weight, the tendency of the small thin metal flakes (b) to cause orientation upon application of the paint becomes disturbed, whereby the plated metal-like appearance is debased. On the other hand, when the clear coating is applied onto the uncured coating film in a wet-on-wet technique, the orientation of the small thin metal flakes is disturbed by the solvent in the clear coating (D) permeated therefrom, whereby the plated metal-like appearance is debased.

As another resin (d) capable of being incorporated in the film-forming resin other than the cellulosic resin (c), those which are used usually for coating can be used without restriction. For example, it is possible to formulate a non-cross-linking lacquer from an acrylic resin, polyolefin resin, chlorinated polyolefin resin, polyester resin or alkyd resin either solely or in a combination, or to formulate a curable cross-linking paint therefrom under combination with a cross-linking agent, for example, an isocyanate compound or a melamine resin.

The weight proportion of the small thin metal flakes (b) relative to the coating film-forming resin component may favorably be in the range from 1/0.3 to 1/40, especially 1/1 to 1/20, as mentioned previously. When the proportion of the coating film-forming resin component is lower than the lowest limit of the above-mentioned range, a cohesive failure may occur upon the coating film adhesion test. On the other hand, when the proportion of the coating film-forming resin component exceeds the highest limit of the above-mentioned range, the orientation of the small thin metal flakes (b) becomes insufficient and the plated metal-like appearance is debased.

In the method for forming a coated film according to the present invention, application of the coating composition onto the substrate is carried out at an application concentration of solid matter of the coating composition in the range from 0.1 to 10% by weight, preferably from 0.5 to 8% by weight. If the solid matter content upon application exceeds 10% by weight, the atomization of the coating composition may become insufficient, whereby the plated metal-like appearance is debased.

The coating composition according to the present invention may contain other pigment(s), additives and so on, if necessary.

The air spray gun to be employed for applying the coating composition onto the substrate may favorably be of the type in which the coating composition is atomized by making use of air pressure, wherein the gun may preferably have a nozzle diameter of 3 mm or less, in particular, 0.8–2 mm. A gun having a nozzle diameter exceeding 3 mm may result in an inferior atomization and decreases the plated metal-like appearance. For supplying the coating composition to the air spray gun, every technique known heretofore may be employed, for example, those of gravity, aspiration and pressure feed types.

It is favorable to adjust the spraying air pressure in the air cap of the spray gun at 45–245 kPa, preferably at 90–200 kPa. If the spraying air pressure is less than 45 kPa, the atomization of the coating composition becomes inferior and the plated metal-like appearance is debased. On the other hand, if it exceeds 245 kPa, the brightening pigment in the coating composition will deform when the coating composition is sprayed onto the substrate, so that a coating film exhibiting a continuous plated metal-like appearance is difficultly formed. Here, the spraying air supply rate is usually in the range from 200 to 600 liters per minute, preferably from 200 to 500 liters per minute. In this invention, the air volume expressed by liter refers to that in the normal state.

On the other hand, for the case of using a low pressure air spray gun, the nozzle diameter corresponds to that of the above-described air spray gun, while the spraying air supply rate may favorably be adjusted at 400–600 liters per minute or, further, at 400–500 liters per minute. Here, the low pressure air spray gun used herein refers to that corresponding to the air pressure range of 0.1–10 psi stipulated in Guideline of California Regulation No. 1151, USA. In the present invention, the spraying air pressure may favorably be in the range from 0.5 to 10 psi. When the spraying air supply rate in a low pressure air spray gun is less than 400 liters per minute, the atomization of the coating composition becomes inferior and the plated metal-like appearance will be debased. On the other hand, if the spraying air supply rate exceeds 600 liters per minute, the coating composition will become deposited on the substrate while causing the brightening pigment therein to be deformed, so that a coating film exhibiting a continuous plated metal-like appearance will difficultly be formed.

The metallic coating composition according to the present invention may be the first metallic paint (B) to be used in the method for forming a coating film according to the present invention as described above, which comprises a solvent, a brightening pigment and a coating film-forming resin component, in which the brightening pigment is composed of either non-leafing type aluminum flakes (a) or, alternatively, non-leafing type aluminum flakes (a) plus small thin metal flakes (b), wherein the weight ratio of the non-leafing type aluminum flakes (a) relative to the small thin metal flakes (b) is in the range from 1/0 to 1/20 and the weight ratio of the brightening pigment to the coating film-forming resin component is in the range from 1/0.3 to 1/40.

The metallic coating composition according to the present invention may also be the second metallic paint (C) used in the method for forming a coating film according to the present invention as described above, which comprises a solvent, a brightening pigment and a coating film-forming resin component, in which the brightening pigment is composed of either small thin metal flakes (b) or, alternatively, small thin metal flakes (b) plus non-leafing type aluminum flakes (a), wherein the weight ratio of the small thin metal flakes (b) relative to the non-leafing type aluminum flakes (a) is in the range from 1/0 to 1/20 and the weight ratio of the brightening pigment to the coating film-forming resin component is in the range from 1/0.3 to 1/40.

The metallic coating composition according to the present invention used in the method for forming a coating film according to the present invention as described above may further be one which comprises a solvent, a brightening pigment and a coating film-forming resin component, in which the brightening pigment is composed of small thin metal flakes (b) having flake thicknesses not greater than 0.08 $\mu$m and an average particle size in the range from 5 to 40 $\mu$m and non-leafing type aluminum flakes (a) having flake thicknesses in the range from 0.1 to 1 $\mu$m and an average particle size in the range from 1 to 60 $\mu$m, wherein the weight ratio of the brightening pigment to the coating film-forming resin component is in the range from 1/0.3 to 1/40 and the weight ratio of the small thin metal flakes (b) to the non-leafing type aluminum flakes (a) is in the range from 1/0.05 to 1/20.

As described above, the method according to the present invention can provide a coating film, which reveals no problems in material properties, is superior in the hiding power for hiding sand scratches on the substrate, exhibits a plated metal-like appearance and is capable of forming a coating film showing a continuous plated metal-like appearance in a stable manner.

THE BEST MODE FOR EMBODYING THE INVENTION

Below, the present invention will further be described in more detail by way of Examples and Comparative Examples, wherein it is to be understood that such description does not mean a restriction of the invention in any respect. In the Examples and Comparative Examples, "part" and "%" are on a weight basis, if not specifically mentioned otherwise.

Production Example 1

Preparation of the First Metallic Paint (B)

To 100 parts by weight of each of the first metallic paints of Examples and Comparative Examples as given in Tables 1 to 4, there were added 80 parts by weight of a 50/50 mixed solvent of butyl acetate/toluene and the resulting mixture was agitated to obtain each diluted coating composition.

Production Example 2

Preparation of the Second Metallic Paint (C)

To 100 parts by weight of each of the second metallic paints of the Examples and Comparative Examples as given in Tables 1 to 4, there were added 100 parts by weight of a 50/50 mixed solvent of butyl acetate/toluene and the resulting mixture was agitated to obtain each diluted coating composition.

EXAMPLES 1 TO 7

Comparative Examples 3 to 8

A cationic electrodepositing paint AQUA No. 4200 F based on an epoxy resin (trademark, a product of NOF Corporation) was electrodeposited on a chemically treated steel plate of PALBONDE #3020 (trademark, a product of Nihon Parkerizing CO., Ltd.) of dull steel having a size of 7 cm×15 cm with a thickness of 0.8 mm so as to attain a dry coating film thickness of 25 $\mu$m and the coating film was baked at 175° C. for 30 minutes. Thereon was then coated an intermediate coating of HI-EPICO No. 150 (trademark, a product of NOF Corporation) by spray coating so as to attain a dry coating film thickness of 30 $\mu$m, whereupon the coating was allowed to stand at room temperature for 10 minutes and the coating film was then baked at 140° C. for 30 minutes to obtain an intermediate coated plate. This intermediate coated plate was ground by sanding with a #600 emery paper described by JIS R 6252 over half its area, followed by degreasing with isopropyl alcohol to obtain the testing substrate to be coated.

Onto each substrate, a diluted paint of each of the first metallic paints of Examples 1 to 7 and Comparative Examples 3 to 8 as given in Tables 1 and 2 was applied by spray coating so as to attain a dry coating film thickness of 6 $\mu$m, followed by standing at room temperature for 3 minutes, whereupon a diluted paint of each of the coating compositions of the second metallic paints was coated thereon by spray coating so as to obtain a dry coating film thickness of 4 $\mu$m. After standing at room temperature for 10 minutes, the so obtained coated plate was baked at 140° C. for 30 minutes to obtain the coated test panel. Using these test panels, the plated metal-like appearance, the coating film adhesion and the hiding power for hiding sand scratches on the substrate were assessed by the following assessment criteria:

(1) The plated metal-like appearance

The plated metal-like appearance was estimated by visual judgment with

◎ being finished in a very excellent plated metal-like appearance,

○ being finished in a plated metal-like appearance and x being finished in a usual silver metallic appearance.

(2) The adhesion onto the substrate

The adhesion of the coating film onto the substrate was examined in such a manner that the coating film on the substrate was cut by parallel cut lines reaching the substrate face in rectangularly crossing directions so as to leave 100 small square cut areas of 1 mm×1 mm using a cutter knife, whereupon a cellophane adhesive tape was attached onto the cut areas and the so-attached cellophane adhesive tape was peeled off abruptly. The number of squares remaining on the cut surface of the substrate after the peeling test were observed, wherein ○ indicates that no cut square was peeled off and x indicated that at least 10 cut squares were peeled off.

(3) The hiding power for hiding sand scratches on the substrate

The hiding power for hiding sand scratches on the substrate was evaluated by visually comparing the state of the coating film between that on the surface area of the substrate ground by sanding with a #600 emery paper described in JIS R 6252 and that on the surface area not ground by sanding, with the evaluation criteria:

◎ completely no visual abnormality,

○ no visual abnormality and x presence of visible sanding scratches on the substrate.

The test results are given in Tables 1 and 2.

Comparative Examples 1 and 2

A cationic electrodepositing paint AQUA No. 4200 F based on an epoxy resin (trademark, a product of NOF Corporation) was electrodeposited on a chemically treated steel plate of PALBONDE #3020 (trademark, a product of Nihon Parkerizing CO., Ltd.) of dull steel having a size of 7 cm×15 cm with a thickness of 0.8 mm so as to attain a dry coating film thickness of 25 μm and the coating film was baked at 175° C. for 30 minutes. Thereon was then coated an intermediate coating of HI-EPICO No. 150 (trademark, a product of NOF Corporation) by spray coating so as to attain a dry coating film thickness of 30 μm, whereupon the coating was allowed to stand at room temperature for 10 minutes and the coating film was then baked at 140° C. for 30 minutes to obtain an intermediate coated plate. This intermediate coated plate was ground by sanding with a #600 emery paper described in JIS R 6252 over half its area, followed by degreasing with isopropyl alcohol to obtain the testing substrate to be coated.

Onto each substrate, a diluted paint of each of the first metallic paints of Comparative Examples 1 and 2 as given in Table 2 was applied by spray coating so as to attain a dry coating film thickness of 10 μm, followed by standing at room temperature for 10 minutes, whereupon the so-obtained coated plate was baked at 140° C. for 30 minutes to obtain the coated test panel. Using these test panels, the plated metal-like appearance, the coating film adhesion and the hiding power for hiding the sand scratches on the substrate were assessed by the assessment criteria as given above. The results of the assessment are given in Table 2.

TABLE 1

| | | Example | | | | | | |
|---|---|---|---|---|---|---|---|---|
| | | 1 | 2 | 3 | 4 | 5 | 6 | 7 |
| 1st Metallic Paint<br>Paint composition (part) | | | | | | | | |
| Sap FM 4010 (a) | *1 | 7.69 | 1.83 | 0.70 | 7.69 | 7.69 | 7.69 | 3.85 |
| METALURE (b) | *2 | — | — | 45.45 | — | — | — | 25.00 |
| ACRYDIC A-345 | *3 | 20.36 | 24.24 | 20.36 | 20.36 | 20.36 | 20.36 | 20.36 |
| SUPER BECKAMIN L-116-70 | *4 | 7.06 | 8.40 | 7.06 | 7.06 | 7.06 | 7.00 | 7.06 |
| CAB 381-0.5 | *5 | 4.00 | 4.76 | 4.00 | 4.00 | 4.00 | 4.00 | 4.00 |
| Butyl acetate | | 60.89 | 60.77 | 22.43 | 60.89 | 60.89 | 60.89 | 39.73 |
| Total (part) | | 100.00 | 100.00 | 100.00 | 100.00 | 100.00 | 100.00 | 100.00 |
| Bright. pigm./film-form. resin[1)] | | 1/4 | 1/20 | 1/4 | 1/4 | 1/4 | 1/4 | 1/4 |
| (a)/(b) | | 1/0 | 1/0 | 1/10 | 1/0 | 1/0 | 1/0 | 1/1 |
| 2nd Metallic Paint<br>Paint composition (part) | | | | | | | | |
| Sap FM 4010 (a) | | — | — | — | — | 3.36 | 0.74 | — |
| METALURE (b) | | 24.00 | 24.00 | 24.00 | 5.71 | 2.18 | 19.20 | 24.00 |
| ACRYDIC A-345 | | 9.77 | 9.77 | 9.77 | 11.64 | 9.77 | 9.77 | 9.77 |
| SUPER BECKAMIN L-116-70 | | 3.38 | 3.38 | 3.38 | 4.03 | 3.38 | 3.38 | 3.38 |
| CAB 381-0.5 | | 1.92 | 1.92 | 1.92 | 2.29 | 1.92 | 1.92 | 1.92 |
| Butyl acetate | | 60.93 | 60.93 | 60.93 | 76.33 | 79.39 | 64.99 | 60.93 |
| Total (part) | | 100.00 | 100.00 | 100.00 | 100.00 | 100.00 | 100.00 | 100.00 |
| Bright. pigm./film-form. resin[1)] | | 1/4 | 1/4 | 1/4 | 1/20 | 1/4 | 1/4 | 1/4 |
| (b)/(a) | | 1/0 | 1/0 | 1/0 | 1/0 | 1/10 | 1/0.25 | 1/0 |
| Plated metal-like appearance | | ◎ | ◎ | ◎ | ○ | ○ | ◎ | ◎ |
| Film adhesion onto the substrate | | ○ | ○ | ○ | ○ | ○ | ○ | ○ |
| Hiding power for hiding sand scratch | | ◎ | ○ | ○ | ◎ | ◎ | ◎ | ◎ |

Notes for Table 1:

*1 Sap FM 4010 (trademark, a product of Showa Alumipowder K.K.), non-leafing type aluminum flakes having a flake thickness of 0.2 μm and an average particle size 11 μm, with a heating residue content of 65%.

*2 METALURE (trademark, a product of the firm Avery Dennison), small thin metal flakes having a flake thickness in the range from 0.01 to 0.08 μm, an average particle size in the range from 6 to 16 μm and a heating residue content of 10%.

*3 ACRYDIC A-345 (trademark, a product of Dainippon Ink & Chemicals, Inc.), an acrylic resin varnish having a heating residue content of 55%.

TABLE 1-continued

| | Example | | | | | | |
|---|---|---|---|---|---|---|---|
| | 1 | 2 | 3 | 4 | 5 | 6 | 7 |

*4 SUPER BECKAMIN L-116-70 (trademark, a product of Dainippon Ink & Chemicals Inc.) a butyrated melamine resin having a heating residue content of 68%.
*5 CAB 381-05 (trademark, a product of the firm Eastmann Chemicals), a cellulose ester.
[1)]Weight ratio of the brightening pigment to the film-forming resin component.

TABLE 2

| | | Comparative Example | | | | | | | |
|---|---|---|---|---|---|---|---|---|---|
| | | 1 | 2 | 3 | 4 | 5 | 6 | 7 | 8 |
| 1st Metallic Paint | | | | | | | | | |
| Paint composition (part) | | | | | | | | | |
| Sap FM 4010 (a) | *1 | 7.69 | — | 30.77 | 0.84 | 0.25 | 7.69 | 7.69 | 7.69 |
| METALURE (b) | *2 | — | 50.00 | — | — | 48.39 | — | — | — |
| ACRYDIC A-345 | *3 | 20.36 | 20.36 | 5.09 | 24.90 | 20.36 | 20.36 | 20.36 | 20.36 |
| SUPER BECKAMIN L-116-70 | *4 | 7.06 | 7.06 | 1.76 | 8.63 | 7.06 | 7.06 | 7.06 | 7.06 |
| CAB 381-0.5 | *5 | 4.00 | 4.00 | 1.00 | 4.89 | 4.00 | 4.00 | 4.00 | 4.00 |
| Butyl acetate | | 60.89 | 18.58 | 61.38 | 60.74 | 19.94 | 60.89 | 60.89 | 60.89 |
| Total (part) | | 100.00 | 100.00 | 100.00 | 100.00 | 100.00 | 100.00 | 100.00 | 100.00 |
| Bright. pig./film-form. resin[1)] | | 1/4 | 1/4 | 1/0.25 | 1/45 | 1/4 | 1/4 | 1/4 | 1/4 |
| (a)/(b) | | 1/0 | 0/1 | 1/0 | 1/0 | 1/30 | 1/0 | 1/0 | 1/0 |
| 2nd Metallic Paint | | | | | | | | | |
| Paint composition (part) | | | | | | | | | |
| Sap FM 4010 (a) | | — | — | — | — | — | — | — | 3.57 |
| METALURE (b) | | — | — | 24.00 | 24.00 | 24.00 | 96.00 | 2.61 | 0.77 |
| ACRYDIC A-345 | | — | — | 9.77 | 9.77 | 9.77 | 2.44 | 11.95 | 9.77 |
| SUPER BECKAMIN L-116-70 | | — | — | 3.38 | 3.38 | 3.38 | 0.85 | 4.14 | 3.38 |
| CAB 381-0.5 | | — | — | 1.92 | 1.92 | 1.92 | 0.48 | 2.35 | 1.92 |
| Butyl acetate | | — | — | 60.93 | 60.93 | 60.93 | 0.23 | 78.95 | 80.59 |
| Total (part) | | — | — | 100.00 | 100.00 | 100.00 | 100.00 | 100.00 | 100.00 |
| Bright. pig./film-form. resin[1)] | | — | — | 1/4 | 1/4 | 1/4 | 1/0.25 | 1/45 | 1/4 |
| (b)/(a) | | — | — | 1/0 | 1/0 | 1/0 | 1/0 | 1/0 | 1/30 |
| Plated metal-like appearance | | X | ○ | ◎ | ◎ | ◎ | ◎ | X | X |
| Film adhesion onto the substrate | | ○ | ○ | X | ○ | ○ | X | ○ | ○ |
| Hiding pow. f. hid. sand scratch | | ○ | X | ◎ | X | X | ◎ | ◎ | ◎ |

Notes:
*1 to *5 and [1)]: See Notes for Table 1.

EXAMPLES 8 TO 14

Comparative Examples 11 to 16

A test plate of an ABS resin, KURARASTICK MV, of Sumitomo A & L K.K. of a size of 7 cm×12 cm having a thickness of 3 mm was ground over half its area by sanding using a #600 emery paper described in JIS R 6252. The test plate was then degreased using isopropyl alcohol to obtain the test substrate to be coated. The so-obtained substrate was then coated with diluted paint of each of the coating compositions of the first metallic paints of Examples 8 to 14 and of Comparative Examples 11 to 16 as given in Tables 3 and 4 by spray coating, so as to attain a dry coating film thickness of 6 μm, whereupon the so-coated substrate was allowed to stand for 3 minutes at room temperature, before it was coated with diluted paint of each of the coating compositions of the second metallic paints by spray coating, so as to attain a dry coating film thickness of 4 μm, followed by standing at room temperature for 10 minutes. Then, the resulting coated plate was baked at 75° C. for 30 minutes to obtain the test panel. Using these test panels, the plated metal-like appearance, the film adhesion onto the substrate and the hiding power for hiding sand scratches on the substrate were assessed by the methods described above. The assessment results are given in Tables 3 and 4.

Comparative Examples 9 and 10

A test plate of an ABS resin, KURARASTICK MV, of Sumitomo A & L K.K. of a size of 7 cm x×12 cm having a thickness of 3 mm was ground over half its area by sanding using a #600 emery paper described in JIS R 6252. The test plate was then degreased using isopropyl alcohol to obtain the test substrate to be coated. The so-obtained substrate was then coated with diluted paint of each of the coating compositions of the first metallic paints of Comparative Examples 9 and 10 as given in Table 4 by spray coating, so as to attain a dry coating film thickness of 10 μm, whereupon the so-coated substrate was allowed to stand for 10 minutes at room temperature, before it was baked at 75° C. for 30 minutes to obtain the test panel. Using these test panels, the plated metal-like appearance, the film adhesion onto the substrate and the hiding power for hiding sand scratches on the substrate were assessed by the methods described above. The assessment results are given in Table 4.

TABLE 3

| | | | Example | | | | | | |
|---|---|---|---|---|---|---|---|---|---|
| | | | 8 | 9 | 10 | 11 | 12 | 13 | 14 |
| 1st Metallic Paint: composition (part) | | | | | | | | | |
| Main components | Sap FM 4010 (a) | *1 | 7.69 | 1.83 | 0.70 | 7.69 | 7.69 | 7.69 | 3.85 |
| | METALURE (b) | *2 | — | — | 45.45 | — | — | — | 25.00 |
| | ACRYDIC A-345 | *3 | 23.27 | 27.70 | 23.27 | 23.27 | 23.27 | 23.27 | 23.27 |
| | CAB 381-0.5 | *5 | 4.00 | 4.76 | 4.00 | 4.00 | 4.00 | 4.00 | 4.00 |
| | Butyl acetate | | 60.77 | 60.63 | 22.31 | 60.77 | 60.77 | 60.77 | 39.61 |
| Curing agent | DESMODULE N-75 | *6 | 4.27 | 5.08 | 4.27 | 4.27 | 4.27 | 4.27 | 4.27 |
| Total (part) | | | 100.00 | 100.00 | 100.00 | 100.00 | 100.00 | 100.00 | 100.00 |
| Bright. pigm./film-form. resin[1)] | | | 1/4 | 1/20 | 1/4 | 1/4 | 1/4 | 1/4 | 1/4 |
| (a)/(b) | | | 1/0 | 1/0 | 1/10 | 1/0 | 1/0 | 1/0 | 1/1 |
| 2nd Metallic Paint: composition (part) | | | | | | | | | |
| Main components | Sap FM 4010 (a) | | — | — | — | — | 3.36 | 0.74 | — |
| | METALURE (b) | | 24.00 | 24.00 | 24.00 | 5.71 | 2.18 | 19.20 | 24.00 |
| | ACRYDIC A-345 | | 11.16 | 11.16 | 11.16 | 13.30 | 11.16 | 11.16 | 11.16 |
| | CAB 381-0.5 | | 1.92 | 1.92 | 1.92 | 2.29 | 1.92 | 1.92 | 1.92 |
| | Butyl acetate | | 60.87 | 60.87 | 60.87 | 76.26 | 79.33 | 64.93 | 60.87 |
| Curing agent | DESMODULE N-75 | | 2.05 | 2.05 | 2.05 | 2.44 | 2.05 | 2.05 | 2.05 |
| Total (part) | | | 100.00 | 100.00 | 100.00 | 100.00 | 100.00 | 100.00 | 100.00 |
| Bright. pigm./film-form. resin[1)] | | | 1/4 | 1/4 | 1/4 | 1/20 | 1/4 | 1/4 | 1/4 |
| (b)/(a) | | | 1/0 | 1/0 | 1/0 | 1/0 | 1/10 | 1/0.25 | 1/0.25 |
| Plated metal-like appearance | | | ◎ | ◎ | ◎ | ○ | ○ | ◎ | ◎ |
| Film adhesion onto the substrate | | | ○ | ○ | ○ | ○ | ○ | ○ | ○ |
| Hiding power for hiding sand scratch | | | ◎ | ○ | ○ | ◎ | ◎ | ◎ | ◎ |

Notes:
*1, *2, *3, *5 and [1)]: See the notes in Table 1.
*6: DESMODULE N-75 (trademark, a product of Beyer AG), a polyisocyanate a heating residue content of 75%.

TABLE 4

| | | | Comparative Example | | | | | | | |
|---|---|---|---|---|---|---|---|---|---|---|
| | | | 9 | 10 | 11 | 12 | 13 | 14 | 15 | 16 |
| 1st Metallic Paint Paint composition (part) | | | | | | | | | | |
| Main compo-nents | Sap FM 4010 (a) | *1 | 7.69 | — | 30.77 | 0.84 | 0.25 | 7.69 | 7.69 | 7.69 |
| | METALURE (b) | *2 | — | 50.00 | — | — | 48.39 | — | — | — |
| | ACRYDIC A-345 | *3 | 23.27 | 23.27 | 5.82 | 28.46 | 23.27 | 23.27 | 23.27 | 23.27 |
| | CAB 381-0.5 | *5 | 4.00 | 4.00 | 1.00 | 4.89 | 4.00 | 4.00 | 4.00 | 4.00 |
| | Butyl acetate | | 60.77 | 18.46 | 61.34 | 60.59 | 19.82 | 60.77 | 60.77 | 60.77 |
| Cur. agent | DESMODULE N-75 | *6 | 4.27 | 4.27 | 1.07 | 5.22 | 4.27 | 4.27 | 4.27 | 4.27 |
| Total (part) | | | 100.00 | 100.00 | 100.00 | 100.00 | 100.00 | 100.00 | 100.00 | 100.00 |
| Bright. pig./film-form. resin[1)] | | | 1/4 | 1/4 | 1/0.25 | 1/45 | 1/4 | 1/4 | 1/4 | 1/4 |
| (a)/(b) | | | 1/0 | 0/1 | 1/0 | 1/0 | 1/30 | 1/0 | 1/0 | 1/0 |
| 2nd Metallic Paint Paint composition (part) | | | | | | | | | | |
| Main compo-nents | Sap FM 4010 (a) | | — | — | — | — | — | — | — | 3.57 |
| | METALURE (b) | | — | — | 24.00 | 24.00 | 24.00 | 96.00 | 2.61 | 0.77 |
| | ACRYDIC A-345 | | — | — | 11.16 | 11.16 | 11.16 | 2.79 | 13.65 | 11.16 |
| | CAB 381-0.5 | | — | — | 1.92 | 1.92 | 1.92 | 0.48 | 2.35 | 1.92 |
| | Butyl acetate | | — | — | 60.87 | 60.87 | 60.87 | 0.21 | 78.89 | 80.53 |
| Cur. agent | DESMODULE N-75 | | | | 2.05 | 2.05 | 2.05 | 0.52 | 2.50 | 2.05 |
| Total (part) | | | — | — | 100.00 | 100.00 | 100.00 | 100.00 | 100.00 | 100.00 |
| Bright. pig./film-form. resin[1)] | | | — | — | 1/4 | 1/4 | 1/4 | 1/0.25 | 1/45 | 1/4 |
| (b)/(a) | | | — | — | 1/0 | 1/0 | 1/0 | 1/0 | 1/0 | 1/30 |
| Plated metal-like appearance | | | X | ○ | ◎ | ◎ | ◎ | ◎ | X | X |
| Film adhesion onto the substrate | | | ○ | ○ | X | ○ | ○ | X | ○ | ○ |
| Hiding pow. f. hid. sand scratch | | | ○ | X | ◎ | X | X | ◎ | ◎ | ◎ |

Notes:
*1, *2, *3, *5 and [1)]: See Notes for Table 1.
*6: See the note in Table 3.

From the results as given in Tables 1 to 4, it is seen that the test panels in Examples reveal no problem in the material properties of the coating films and are superior in the coating performances, such as better hiding power for hiding the sand scratches and continuous plated metal-like appearance, whereas the test panels of Comparative Examples are inferior in these properties.

Production Example 3

Production of a Second Metallic Paint (C-i)

This was produced in such a manner that 10.0 parts of small thin metal flakes (*6) were dispersed in 20.0 parts of isobutyl acetate and thereto were added 6.4 parts of an acrylic resin varnish (*7), 4.0 parts of a solution of a cellulosic resin (*8), prepared by dissolving this in isobutyl acetate so as to attain a heating residue content of 20%, and 59.6 parts of ethyl acetate and the resulting mixture was agitated.

Notes:

*6: Small thin metal flakes: METALURE (trademark, a product of the firm Avery Dennison), having a heating residue content of 10%, flake thicknesses in the range of 0.01–0.08 μm and an average particle size of 6–16 μm.

*7: An acrylic resin varnish: ACRYDIC A-190 (trademark, a product of Dainippon Ink & Chemicals, Inc.), having a heating residue content of 50%.

*8: A cellulosic resin: CAB 381-0.5 (trademark, a product of the firm Eastmann Chemicals) of a cellulose ester.

Production Example 4

Production of a Second Metallic Paint (C-ii)

10.8 parts of non-leafing type aluminum flakes (*9) were dispersed in 16.7 parts of isobutyl acetate and thereto were added 44.8 parts of the acrylic resin varnish (*7) used in Production Example 1 and 28.0 parts of a solution prepared by dissolving a cellulosic resin (*8) in isobutyl acetate so as to attain a heating residue content of 20%, whereupon the mixture was agitated.

Note:

*9: Sap FM 4010 (trademark, a product of Showa-Alumipowder K.K.), non-leafing type aluminum flakes having a heating residue content of 65%, a flame thickness of 0.15–0.25 μm and an average particle size of 9–14 μm.

EXAMPLES 15 TO 17

A test plate of an ABS resin, KURARASTICK MV, of Sumitomo A & L K.K. of a size of 7 cm x×12 cm having a thickness of 3 mm was ground over half its area by sanding using a #600 emery paper described in JIS R 6252. The test plate was then degreased using isopropyl alcohol to obtain the test substrate to be coated. The so-obtained substrate was then coated with a primer coating paint, prepared by adding each of the primers of Examples 15 to 18 as given in Table 5 in a 50/50 mixed solvent of isobutyl acetate/xylene so as to adjust the viscosity at 15 seconds (Ford-Cup No. 4, 20° C.), so that a dry coating film thickness of 10 μm was attained. After standing at room temperature for 10 minutes, this plate was then coated with the second metallic paint (C-i) produced in Production Example 3 so as to attain a dry coating film thickness of 5 μm, whereupon the resulting coated plate was allowed to stand for 10 minutes at room temperature, before it was coated with a two-liquid type clear coating paint based on acrylic/urethane resin, HI-URETHANE No. 6500 (trademark, a product of NOF Corporation), so as to attain a dry coating film thickness of 35 μm, followed by standing at room temperature for 10 minutes. Then, the resulting coated plate was baked at 75° C. for 30 minutes so as to cure the coating layer composed of three layers of the primer, the second metallic paint and the clear coating by simultaneously cross-linking, in order to obtain the test panel. Using these test panels, the plated metal-like appearance, the film adhesion onto the substrate and the hiding power for hiding the sand scratches on the substrate were assessed by the assessment criteria given below. The assessment results are given in Table 5.

(1) The plated metal-like appearance

The plated metal-like appearance was estimated by visual judgment with

○ being finished in a plated metal-like appearance and x being finished in a usual silver metallic appearance or with mottling by the solvent of a clear coat.

(2) The film adhesion onto the substrate

The adhesion of the coating film onto the substrate was examined in such a manner that the coating film on the substrate was cut in parallel by cut lines reaching the substrate face in rectangularly crossing directions so as to leave 100 small square cut areas of 1 mm x×1 mm using a cutter knife, whereupon a cellophane adhesive tape was attached onto the cut areas and the so-attached cellophane adhesive tape was peeled off abruptly. The number of squares remaining on the cut surface of the substrate after the peeling test were observed, wherein ○ indicates that no cut square was peeled off and x indicated that at least 10 cut squares were peeled off.

(3) The hiding power for hiding sand scratches on the substrate

The hiding power for hiding sand scratches on the substrate was evaluated by visually comparing the state of the coating film between that on the surface area of the substrate ground by sanding with a #600 emery paper described in JIS R 6252 and that on the surface area not ground by sanding, with the evaluation criteria:

◎ completely no visual abnormality,

○ no visual abnormality and x presence of visible sanding scratch lines on the substrate.

Comparative Example 17

A test plate of an ABS resin, KURARASTICK MV, of Sumitomo A & L K.K. of a size of 7 cm x×12 cm having a thickness of 3 mm was ground over half its area by sanding using a #600 emery paper described in JIS R 6252. The test plate was then coated with the second metallic paint (C-i) produced in Production Example 3 so as to attain a dry coating film thickness of 5 μm, whereupon the resulting coated plate was allowed to stand for 10 minutes at room temperature, before it was coated with a two-liquid type clear coating paint based on acrylic/urethane resin, HI-URETHANE No. 6500 (trademark, a product of NOF Corporation), so as to attain a dry coating film thickness of 35 μm. After standing at room temperature for 10 minutes, the resulting coated plate was baked at 75° C. for 30 minutes to obtain the test panel. Using these test panels, the plated metal-like appearance, the film adhesion onto the substrate and the hiding power for hiding sand scratches on the substrate were assessed in the same manner as in Examples 15–17. The assessment results are given in Table 5.

Comparative Example 18

A test plate of an ABS resin, KURARASTICK MV, of Sumitomo A & L K.K. of a size of 7 cm x×12 cm having a thickness of 3 mm was ground over half its area by sanding using a #600 emery paper described in JIS R 6252. The test plate was then coated with a second metallic paint (C-ii) obtained in Production Example 4 and adjusted using a 50/50 mixed solvent of isobutyl acetate/xylene to a viscosity at 15 seconds (Ford-Cup No. 4, 20° C.), so that a dry coating film thickness of 15 μm was attained. After standing at room temperature for 10 minutes, this plate was then coated with a two-liquid type clear coating paint based on an acrylic/urethane resin, HI-URETHANE No. 6500 (trademark, a product of NOF Corporation), so as to attain a dry coating film thickness of 35 μm, followed by standing at room temperature for 10 minutes. Then, the resulting coated plate was baked at 75° C. for 30 minutes to obtain the test panel. Using these test panels, the plated metal-like appearance, the film adhesion onto the substrate and the hiding power for hiding sand scratches on the substrate were assessed in the same manner as in Examples 15–17. The assessment results are given in Table 5.

TABLE 5

| | | | Example | | | Comp. Example | |
|---|---|---|---|---|---|---|---|
| | | | 15 | 16 | 17 | 17 | 18 |
| Primer: composition (part) | | | | | | | |
| Main components | ACRYDIC BL-616 | *10 | 42.3 | 42.3 | 42.3 | — | — |
| | JR-603 | *11 | 12.5 | 12.5 | 12.5 | — | — |
| | Sap FM 4010 (a) | *9 | — | 5.8 | 19.2 | — | — |
| | Butyl acetate | | 10.0 | 10.0 | 10.0 | — | — |
| | Xylene | | 30.1 | 24.3 | 10.9 | — | — |
| Curing agent | DESMODULE N-75 | *12 | 5.1 | 5.1 | 5.1 | — | — |
| Total (part) | | | 100.00 | 100.00 | 100.00 | — | — |
| Flat pigment (part) | | *13 | 0 | 15 | 50 | — | — |
| 2nd Metallic Paint: | | | (C-i) | (C-i) | (C-i) | (C-i) | (C-ii) |
| Plated metal-like appearance | | | ○ | ○ | ○ | ○ | X |
| Film adhesion onto the substrate | | | ○ | ○ | X | ○ | ○ |
| Hiding power for hiding sand scratches | | | ○ | ◎ | ○ | X | ○ |

Notes in Table 5:
*10: ACRYDIC BL-616 (trademark, a product of Dainippon Ink & Chem., Inc. ), an acrylic resin varnish having a heating residue content of 50%.
*11: JR-603 (trademark, a product of Teika K.K.), titanium dioxide.
*12: DESMODULE-N-75 (trademark, a product of Beyer AG), a polyisocyanate having a heating residue content of 75%.
*13: Parts by weight of the flat pigment per 100 parts by weight of the coating film-forming resin component in the primer.

From the results given in Table 5, it is seen that the coating layer of Example 15 not employing a flat pigment in the primer (A) brings about better results for the plated metal-like appearance, the film adhesion onto the substrate and the hiding power for hiding sand scratches on the substrate, whereas the coating layer of Example 16 incorporating a small amount of a flat pigment in the primer (A) exhibited a more improved hiding power for hiding sand scratches on the substrate, and that the coating film of Example 17 employing a high content of a flat pigment in the primer (A) shows a subordinated film adhesion onto the substrate. Further, it is also seen that the coating film of Comparative Example 17 in which no primer (A) is employed but the second metallic paint (C-i) is incorporated is inferior in hiding power for hiding sand scratches on the substrate, whereas the coating film of Comparative Example 18 in which no primer (A) is incorporated but the second metallic paint (C-ii) is used shows an inferior plated metal-like appearance.

EXAMPLES 18 AND 19

Comparative Examples 19–24

A test plate of an ABS resin, KURARASTICK MV, of Sumitomo A & L K.K. of a size of 7 cm x×12 cm having a thickness of 3 mm was ground over half its area by sanding using a #600 emery paper described in JIS R 6252. The test plate was then degreased using isopropyl alcohol to obtain the test substrate to be coated. Thereafter, a diluted paint was prepared by adding 200 parts by weight of a 50/50 mixed solvent of isobutyl acetate/toluene to 100 parts by weight of each of the coating compositions of Examples and Comparative examples as given in Table 6 with agitation. This diluted paint was applied onto the above obtained test substrate so as to attain a dry coating film thickness of 10 μm by spray coating, followed by standing at room temperature for 10 minutes, whereupon it was coated with a two-liquid type clear coating paint based on acrylic/urethane resin, HI-URETHANE No. 6500 (trademark, a product of NOF Corporation), so as to attain a dry coating film thickness of 35 μm, followed by standing at room temperature for 10 minutes. Then, the resulting coated plate was baked at 75° C. for 30 minutes to obtain the test panel. Using these test panels, the plated metal-like appearance, the film adhesion onto the substrate and the hiding power for hiding sand scratches on the substrate were assessed by the assessment criteria given below. The results of the assessments are given in Table 6.

(1) The plated metal-like appearance

The plated metal-like appearance was estimated by visual judgment with

○ being finished in a plated metal-like appearance and x being finished in a usual silver metallic appearance or with mottling by the solvent of a clear coat.

(2) The film adhesion onto the substrate

The adhesion of the coating film onto the substrate was examined in such a manner that the coating film on the substrate was cut in parallel by cut lines reaching the substrate face in rectangularly crossing directions so as to leave 100 small square cut areas of 1 mm x×1 mm using a cutter knife, whereupon a cellophane adhesive tape was attached onto the cut areas and the so-attached cellophane adhesive tape was peeled off abruptly. The number of squares remaining on the cut surface of the substrate after the peeling tests were observed, wherein ○ indicates that no cut square was peeled off and x indicated that at least 10 cut squares were peeled off.

(3) The hiding power for hiding sand scratches on the substrate

The hiding power for hiding sand scratches on the substrate was evaluated by visually comparing the state of the coating film between that on the surface area of the substrate ground by sanding with a #600 emery paper described in JIS R 62522 and that on the surface area not ground by sanding, with the evaluation criteria:

○ no visual abnormality and x presence of visible sanding scratch lines on the substrate.

diameter of 1.8 mm) at its air cap pressure of 170 kPa and an air feed rate of 280 milliliters per minute, so as to attain a dry coating film thickness of 8 μm, followed by standing at room temperature for 5 minutes. Onto this coated plate, a two-liquid type clear coating paint based on an acrylic/urethane resin, HI-URETHANE No. 6500 (trademark, a product of NOF Corporation), was applied so as to attain a dry coating film thickness of 35 μm. After standing at room temperature for 10 minutes, the coating was baked at 75° C. for 30 minutes to obtain the coated test panel. Using this test panel, the appearance of the coating and the coating film adhesion onto the substrate were evaluated by the method given below. The results of the evaluation are given in Table 7.

(1) The plated metal-like appearance was assessed by visual judgment with

TABLE 6

| | | Example | | Comparative Example | | | | | |
|---|---|---|---|---|---|---|---|---|---|
| | | 18 | 19 | 19 | 20 | 21 | 22 | 23 | 24 |
| Coating composition | | | | | | | | | |
| METALURE (b) | *14 | 33.33 | 33.33 | 80.00 | 2.17 | 47.85 | 1.92 | 50.00 | — |
| Sap FM 4010 (a) | *15 | 2.56 | 2.56 | 6.15 | 0.17 | 0.33 | 7.40 | — | 7.69 |
| ACRYDIC A-190 | *16 | 20.00 | 16.00 | 4.80 | 23.48 | 16.00 | 16.00 | 16.00 | 16.00 |
| CAB 381-0.5 | *17 | — | 2.00 | 0.60 | 2.94 | 2.00 | 2.00 | 2.00 | 2.00 |
| Butyl acetate | | 44.10 | 44.10 | 8.45 | 71.24 | 33.82 | 72.68 | 32.00 | 74.31 |
| Total (part) | | 100.00 | 100.00 | 100.00 | 100.00 | 100.00 | 100.00 | 100.00 | 100.00 |
| Bright. pig./film-form. resin[1)] | | 1/2.0 | 1/2.0 | 1/0.25 | 1/45 | 1/2.0 | 1/2.0 | 1/2.0 | 1/2.0 |
| (b)/(a) | | 1/0.5 | 1/0.5 | 1/0.5 | 1/0.5 | 1/0.04 | 1/25 | — | — |
| Coating film material properties | | | | | | | | | |
| Plated metal-like appearance | | ○ | ○ | ○ | X | ○ | X | ○ | X |
| Film adhesion onto the substrate | | ○ | ○ | X | ○ | ○ | ○ | ○ | ○ |
| Hiding power for sand scratches | | ○ | ○ | ○ | ○ | X | ○ | X | ○ |

Notes in Table 6:
*14: METALURE (trademark, a product of the firm Avery Dennison), small thin metal flakes having flake thicknesses in the range from 0.01 to 0.08 μm, an average particle size in the range from 6 to 16 μm and a heating residue content of 10%.
*15: Sap FM 4010 (trademark, a product of Showa Alumipowder K.K.), non-leafing type aluminum flakes having flake thickness of 0.2 μm and an average particle size of 11 μm, with a heating residue content of 65%.
*16: ACRYDIC A-190 (trademark, a product of Dainippon Ink & Chemicals, Inc. ), an acrylic resin varnish having a heating residue content of 50%.
*17: CAB 381-0.5 (trademark, a product of the firm Eastmann Chemicals), a cellulose ester.
[1)]Weight ratio of the brightening pigment to the film-forming resin component.

From the results given in Table 6, it is seen that the coating films of Examples 18 and 19 exhibit an excellent hiding power for hiding the sand scratches on the substrate together with a continuous plated metal-like appearance and superior film adhesion onto the substrate, whereas the coating films of Comparative Examples 20–24 are all inferior in these coating film properties.

EXAMPLE 20

Comparative Examples 25–28

A test plate of an ABS resin, KURARASTICK MV, of Sumitomo A & L K.K. was degreased in isopropyl alcohol to obtain the test substrate to be coated. Then, metallic paints were prepared from the components given in Table 1, whereupon the test substrate was coated with each of these metallic paints using an air spray gun W-90-18N5P (of Iwata Tosoki K.K., a pressure feed type air spray gun with nozzle ○ being finished in a plated metal-like appearance, Δ being finished to some degree in a plated metal-like appearance and x being finished in a silver metallic appearance or with mottling by the solvent of clear coat.

(2) The adhesion of the coating film onto the substrate was examined in such a manner that the coating film on the substrate was cut in parallel by cut lines reaching the substrate face in crossing directions so as to leave 100 small square cut areas of 1 mm x×1 mm using a cutter knife, whereupon a cellophane adhesive tape was attached onto the cut areas and the so-attached cellophane adhesive tape was abruptly peeled off, in order then to observe the coating film surface. ○ indicates no peeled off cut square present and x shows that at least 10 cut squares were peeled off.

TABLE 7

| | | Example | Comparative Example | | | |
|---|---|---|---|---|---|---|
| | | 20 | 25 | 26 | 27 | 28 |
| (b)/{(c) + (d)} | *21 | 1/2 | 1/0.2 | 1/45 | 1/2 | 1/2 |
| 100 × (c)/{(c) + (d) } | *22 | 20 | 20 | 20 | 3 | 20 |
| Solids content upon application | | 5 | 5 | 5 | 5 | 15 |
| Coating composition | | | | | | |
| METALURE (b) | *18 | 16.67 | 41.67 | 1.09 | 16.67 | 50.00 |
| ACRYDIC A-190 (d) | *19 | 5.32 | 1.32 | 7.83 | 6.47 | 16.00 |
| CAB 381-0.5 (c) | *20 | 0.67 | 0.17 | 0.98 | 0.10 | 2.00 |
| Ethyl acetate | | 57.34 | 36.84 | 70.10 | 46.76 | 12.00 |
| Isobutyl acetate | | 20.00 | 20.00 | 20.00 | 20.00 | 20.00 |
| Total (part) | | 100.00 | 100.00 | 100.00 | 100.00 | 100.00 |
| Plated metal-like appearance | | ○ | ○ | Δ | Δ | X |
| Film adhesion onto the substrate | | ○ | X | ○ | ○ | ○ |

Notes in Table 7:
*18: METALURE (trademark, a product of the firm Avery Dennison), small thin metal flakes having flake thicknesses in the range from 0.01 to 0.08 μm, an average particle size in the range from 6 to 16 μm and a heating residue content of 10%.
*19: ACRYDIC A-190 (trademark, a product of Dainippon Ink & Chemicals, Inc.), an acrylic resin varnish having a heating residue content of 50%.
*20: CAB 381-0.5 (trademark, a product of the firm Eastmann Chemicals), a cellulose ester.
*21: [solids content of METALURE]/{(weight of CAB381–0.5) + (solids content of ACRYDIC A-190)}
*22: 100 × (weight of CAB 381-0.5)/{(weight of CAB 381-0.5) + (solids content of ACRYDIC A-190)}

EXAMPLE 21

Comparative Examples 29–32

A test plate of an ABS resin, KURARASTICK MV, of Sumitomo A & L K.K. was degreased by isopropyl alcohol to obtain the test substrate to be coated. Then, the coating composition of Example 20 as given in Table 7 was applied thereonto under the coating conditions given in Table 8, so as to attain a dry coating film thickness of 8 μm, followed by standing at room temperature for 5 minutes. Onto this coated plate was then applied a two-liquid type clear coating paint based on acrylic/urethane resin, HI-URETHANE No. 6500 (trademark, a product of NOF Corporation), so as to attain a dry coating film thickness of 35 μm. After standing at room temperature for 10 minutes, the coating was baked at 75° C. for 30 minutes to obtain the coated test panel. Using this test panel, the appearance of the coating and the coating film adhesion onto the substrate were evaluated in the same manner as in Example 20. The results of evaluations are given in Table 8. The spray guns given in Table 8 are as follows:

(I) F100L-P (trademark, supplied from Meiji Kikai K.K.) of pressure feed type low pressure spray gun.
(II) 59Ax241-P1 (trademark, supplied from the firm Binks) of pressure feed type air spray gun.
(III) W-90-18N5P (trademark, supplied from Iwata Tosoki K.K.), a pressure feed type air spray gun.

TABLE 8

| | Example 21 | Comp. Ex. 29 | Comp. Ex. 30 | Comp. Ex. 31 |
|---|---|---|---|---|
| Spray gun | (I) | (II) | (III) | (I) |
| Nozzle diameter (mm) | 1.0 | 4.3 | 1.8 | 1.0 |
| Air pressure (kPa) | 68 | 170 | 400 | 68 |
| Air feed rate (ml/min) | 500 | 280 | 280 | 800 |

TABLE 8-continued

| | Example 21 | Comp. Ex. 29 | Comp. Ex. 30 | Comp. Ex. 31 |
|---|---|---|---|---|
| Plated metal-like appearance | ○ | x | x | Δ |
| Coating film adhesion | ○ | ○ | ○ | ○ |

From the results given in Table 7, it is seen that the plated metal-like appearance and the film adhesion may not be compatible, if the coating composition is not in the range defined by the present invention, even if the coating condition is in the range defined by the present invention. From the results given in Table 8, it is further seen that the better plated metal-like appearance may not be attained, if the coating condition is not in the range defined by the present invention, even though the coating composition is in the range defined by the present invention. On the other hand, Examples satisfying both these conditions indicate a better plated metal-like appearance with better film adhesion.

INDUSTRIAL APPLICABILITY

By the method for forming a coating film as well as the coating composition according to the present invention, it is possible to build up, in a stable manner, coating films revealing no problems and exhibiting a continuous plated metal-like appearance with a higher hiding power for hiding sand scratches on the substrate and, therefore, articles exhibiting a brilliant continuous plated metal-like appearance which have hitherto been obtained by vapor deposition or metal plating can be produced simply by coating and such a technique may be applied for articles requiring metallic lustrous surfaces, such as automobile, household electric and electronic appliances.

What is claimed is:

1. A method for forming a coating film on a substrate comprising applying onto the substrate a primer (A) containing a flat pigment and a film-forming resin in a weight ratio of 0.1–40 parts by weight of flat pigment per 100 parts by weight of the film-forming resin and/or a first metallic paint (B) containing non-leafing aluminum flakes (a) having thicknesses in the range from 0.1 to 1 μm and an average flake diameter in the range from 1 to 60 μm and, then, applying thereonto a second metallic paint (C) containing small thin metal flakes (b) having thicknesses not greater than 0.08 μm and an average flake diameter in the range from 5 to 40 μm.

2. The method as claimed in claim 1, wherein the primer (A) and/or the first metallic paint (B) and the second metallic paint (C) are applied sequentially on the substrate in a wet-on-wet technique.

3. The method as claimed in claim 1, wherein a heating step is incorporated after the application of the primer (A) and/or the first metallic paint (B), whereupon the second metallic paint (C) is applied thereonto.

4. The method for forming a coating film on a substrate as claimed in claim 1, further comprising coating by spray-coating a coating composition containing a solvent, the small thin metal flakes (b) and a film-forming resin component on the substrate using an air spray gun, wherein the small thin metal flakes (b) have thicknesses not greater than 0.08 μm and an average flake diameter in the range from 5 to 40 μm and the film forming resin component is constituted of a cellulosic resin or of a cellulosic resin and resin(s) other than cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a nozzle diameter not greater than 3 mm, with the spraying air pressure at the air cap being in the range from 45 to 245 kPa.

5. The method for forming a coating film on a substrate as claimed in claim 1, further comprising coating by spray-coating a coating composition comprising a solvent, the small thin metal flakes (b) and a film-forming resin component on the substrate using an air spray gun, wherein the small thin metal flakes (b) have thicknesses not greater than 0.08 μm and an average flake diameter in the range from 5 to 40 μm and wherein the film-forming resin component is constituted of a cellulosic resin or of a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a spraying air pressure of 0.1–10 psi and a nozzle diameter not greater than 3 mm, with the spraying air discharge rate being in the range from 400 to 600 liter/min.

6. A metallic coating composition to be used in the method claimed in claim 1 as the first metallic paint (B), which comprises a solvent, a brightening pigment and a film-forming resin component, the coating composition comprising non-leafing aluminum flakes (a) or non-leafing aluminum flakes (a) and small thin metal flakes (b) as the brightening pigment, with the weight ratio of the non-leafing aluminum flakes (a) to the small thin metal flakes (b) being not higher than 20 parts by weight of the small thin metal flakes (b) per one part by weight of the non-leafing aluminum flakes (a) and the weight ratio of the brightening pigment to the film-forming resin component being in the range from 1/0.3 to 1/40.

7. A metallic coating composition to be used in the method claimed in claim 1 as the second metallic paint (C), which comprises a solvent, a brightening pigment and a film-forming resin component, the coating composition comprising small thin metal flakes (b) or small thin metal flakes (b) plus non-leafing aluminum flakes (a) as the brightening pigment, with the weight ratio of the small thin metal flakes (b) to the non-leafing aluminum flakes (a) being not higher than 20 parts by weight of the small thin metal flakes (b) per one part by weight of the non-leafing aluminum flakes (a) and the weight ratio of the brightening pigment to the film-forming resin component being in the range from 1/0.3 to 1/40.

8. A method for forming a coating film on a substrate comprising applying onto the substrate a primer (A) and/or a first metallic paint (B) containing non-leafing aluminum flakes (a) having thicknesses in the range from 0.1 to 1 μm and an average flake diameter in the range from 1 to 60 μm and, then, applying thereonto a second metallic paint (C) containing small thin metal flakes (b) having thicknesses not greater than 0.08 μm and an average flake diameter in the range from 5 to 40 μm and a clear coating (D) successively.

9. The method as claimed in claim 8, wherein the primer (A) and/or the first metallic paint (B), the second metallic paint (C) and the clear coating (D) are applied sequentially on the substrate in a wet-on-wet technique.

10. The method as claimed in claim 8, wherein a heating step is incorporated after the application of the primer (A) and/or the first metallic paint (B), whereupon the second metallic paint (C) and the clear coating (D) are applied sequentially thereonto.

11. The method as claimed in claim 8, wherein a heating step is incorporated after the primer (A) and/or the first metallic paint (B) and, then, the second metallic paint (C) have sequentially been applied, whereupon the clear coating (D) is applied thereonto.

12. The method as claimed in claim 8, wherein a heating step is incorporated after the application of the primer (A) and/or the first metallic paint (B), followed by application of the second metallic paint (C) thereonto with subsequent heating of the coating, upon the clear coating (D) is applied thereonto.

13. A method for forming a coating film on a substrate by spray-coating a coating composition containing a solvent, small thin metal flakes (b) and a film-forming resin component on the substrate using an air spray gun, wherein the small thin metal flakes (b) have thicknesses not greater than 0.08 μm and an average flake diameter in the range from 5 to 40 μm and the film-forming resin component is constituted of a cellulosic resin or of a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a nozzle diameter not greater than 3 mm and a spraying air pressure at an air cap in the range from 45 to 245 kPa.

14. A method for forming a coating film on a substrate by spray-coating a coating composition containing a solvent, small thin metal flakes (b) and a film-forming resin component on the substrate using an air spray gun, wherein the small thin metal flakes (b) have thicknesses not greater than 0.08 μm and an average flake diameter in the range from 5 to 40 μm and the film-forming resin component is constituted of a cellulosic resin or of a cellulosic resin and resin(s) other than a cellulosic resin, the weight ratio of the small thin metal flakes (b) to the film-forming resin component being in the range from 1/0.3 to 1/40 and the content of the cellulosic resin in the film-forming resin component being in the range from 5 to 100% by weight, wherein the content of solids in the coating composition upon application is in the range from 0.1 to 10% by weight and the air spray gun has a spraying air pressure of 0.1–10 psi, a nozzle diameter not greater than 3 mm, and a spraying air discharge rate in the range from 400 to 600 liter/min.

15. A coating composition comprising a solvent, a brightening pigment and a film-forming resin component, the coating composition containing, as the brightening pigment, small thin metal flakes (b) having thicknesses not greater than 0.08 μm and an average flake diameter in the range from 5 to 40 μm and non-leafing aluminum flakes (a) having thicknesses in the range from 0.1 to 1 μm and an average flake diameter in the range from 1 to 60 μm, with the weight ratio of the brightening pigment to the film-forming resin component being in the range from 1/0.3 to 1/40 and the weight ratio of the small thin metal flakes (b) to the non-leafing aluminum flakes (a) being in the range from 1/0.05 to 1/20.

* * * * *

UNITED STATES PATENT AND TRADEMARK OFFICE

CERTIFICATE OF CORRECTION

PATENT NO. : 6,331,326 B1
DATED : December 18, 2001
INVENTOR(S) : Takeshi Tsunoda et al.

It is certified that error appears in the above-identified patent and that said Letters Patent is hereby corrected as shown below:

Column 27,
Line 25, replace "film forming" with -- film-forming --.
Line 27, after "than" insert -- a --.

Column 28,
Line 43, replace "upon" with -- whereupon --.

Signed and Sealed this

Thirtieth Day of April, 2002

*Attest:*

*Attesting Officer*

JAMES E. ROGAN
*Director of the United States Patent and Trademark Office*